US010945511B2

(12) United States Patent
Bourque

(10) Patent No.: US 10,945,511 B2
(45) Date of Patent: Mar. 16, 2021

(54) FLUID DISPENSING PERSONAL CARE PRODUCT

(71) Applicant: The Gillette Company LLC, Boston, MA (US)

(72) Inventor: Steven Michael Bourque, Billerica, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/430,909

(22) Filed: Jun. 4, 2019

(65) Prior Publication Data

US 2019/0365079 A1 Dec. 5, 2019

Related U.S. Application Data

(60) Provisional application No. 62/680,327, filed on Jun. 4, 2018.

(51) Int. Cl.

| | |
|---|---|
| ***A45D 40/00*** | (2006.01) |
| ***A45D 27/00*** | (2006.01) |
| ***B26B 21/44*** | (2006.01) |
| *B26B 21/40* | (2006.01) |

(52) U.S. Cl.

CPC ..... *A45D 40/0081* (2013.01); *A45D 27/00* (2013.01); *B26B 21/446* (2013.01); *B26B 21/4018* (2013.01); *B26B 21/4025* (2013.01); *B26B 21/4031* (2013.01)

(58) Field of Classification Search

CPC .. A45D 34/06; A45D 27/00; A45D 2034/005; B26B 21/4062; B26B 21/446; B26B 21/528; B26B 21/4018; B26B 21/4025

USPC ..... 222/336, 406, 511, 518

See application file for complete search history.

(56) References Cited

U.S. PATENT DOCUMENTS

| | | | | |
|---|---|---|---|---|
| 4,850,107 | A | 7/1989 | Valliades | |
| 5,049,048 | A * | 9/1991 | Streicher | F04B 43/12 417/477.12 |
| 6,789,321 | B2 | 9/2004 | Simms | |
| 7,252,208 | B1 * | 8/2007 | Alvino | B65D 83/0463 221/28 |
| 7,997,453 | B1 * | 8/2011 | Gallegos | A45D 34/04 222/207 |
| 8,887,369 | B2 | 11/2014 | Burrowes | |
| 9,962,844 | B2 | 5/2018 | Burrowes | |

(Continued)

FOREIGN PATENT DOCUMENTS

EP 0427889 A1 5/1991

OTHER PUBLICATIONS

PCT Search Report, PCT/US2019/035166 dated Jul. 26. 2019, 12 pages.

*Primary Examiner* — Donnell A Long
(74) *Attorney, Agent, or Firm* — John M. Lipchitz

(57) ABSTRACT

A fluid dispensing personal care product with a handle defining a cavity with a support surface. A fluid reservoir containing a volume of a fluid is configured to attach to the handle. An actuator on the handle that has a pump contacting surface. A pump system positioned within the handle includes a flexible fluid collector configured to dispense fluid from the fluid reservoir to an exit port. The flexible fluid collector contacts the support surface of the handle and the pump contacting surface of the actuator in a neutral position.

20 Claims, 10 Drawing Sheets

(56) References Cited

U.S. PATENT DOCUMENTS

| | | | | |
|---|---|---|---|---|
| 2007/0050997 | A1* | 3/2007 | Schnak | B26B 21/38 30/526 |
| 2008/0215029 | A1* | 9/2008 | Rake | A61M 5/148 604/408 |
| 2012/0102761 | A1 | 5/2012 | Jessemey | |
| 2013/0067714 | A1 | 3/2013 | Szczepanowski | |
| 2013/0145601 | A1 | 6/2013 | Burrowes | |
| 2015/0121703 | A1 | 5/2015 | Bridges | |
| 2015/0121704 | A1* | 5/2015 | Bridges | B26B 21/446 30/41 |
| 2015/0375410 | A1 | 12/2015 | Wain | |
| 2017/0327296 | A1* | 11/2017 | Ettlin | B01F 15/0087 |

* cited by examiner

FLUID DISPENSING PERSONAL CARE PRODUCT

FIELD OF THE INVENTION

This invention relates to fluid dispensing personal care products and more particularly to fluid dispensing razors.

BACKGROUND OF THE INVENTION

When a consumer engages in the wet shaving experience, it is typical to apply a skin preparation, e.g., shaving soap, shaving cream, shaving gel, skin conditioning foam, etc., via a brush or manual application prior to movement of the razor along the skin's surface. Most consumers find this type of preparation to be rather inconvenient because of the need for multiple shaving products, e.g., a wet razor and a skin preparation product, as well as the undesirable necessity for multiple application steps during the wet shaving process. This multi-step process also results in an overall extended shaving experience which most consumers do not prefer given typical morning hygiene routines. It may, however, be desirable sometimes to apply fluids of other kinds to the skin before, during, or after shaving. It has been found that especially in the case of males who shave facial hair, it is important to provide a shave preparation of some sort prior to shaving in order to adequately hydrate the coarser facial hairs to allow for an easier and closer shave. It may also be beneficial to apply a lotion after shaving to help reduce irritation or moisturize the skin.

In the past, there have been a number of wet shaving product configurations that include a system for conveying a shaving preparation during shaving, e.g., a lubricating fluid, from a reservoir incorporated in the razor structure in the form of a hollowed-out razor handle or even an aerosol can that acts as a razor handle, to a dispensing location near the head of the razor. A number of more recent wet razors have cartridges that are movably mounted, in particular pivotable, relative to the handle structures on which they are mounted either permanently, in the case of disposable safety razors intended to be discarded when the blade or blades have become dulled, or detachably to allow replacement of the blade unit on a reusable handle structure. An exemplary razor of this sort is disclosed in U.S. Pat. No. 6,789,321 or 7,127,817. Many of these types of razors that are capable of conveying a liquid to the skin surface are unfortunately plagued by a number of problems. For instance, the inner workings of the razors tend to be cost prohibitive from a large scale manufacturing standpoint. Additionally, there are performance issues that are constantly experienced due inefficient displacement of the liquid when the device is first used and when a new reservoir is used.

In view of these deficiencies with liquid dispensing razors there is a need for a razor that is capable of dispensing a liquid during shaving that is cost effective and reliable. Particularly, there is a need a liquid dispensing wet shaving razor that can dispense a composition during shaving when the skin needs it most that overcomes the aforementioned problems.

SUMMARY OF THE INVENTION

In an aspect, the invention features a fluid dispensing personal care product with a handle defining a cavity with a support surface. A fluid reservoir containing a volume of a fluid is configured to attach to the handle. An actuator on the handle that has a pump contacting surface. A pump system positioned within the handle includes a flexible fluid collector configured to dispense fluid from the fluid reservoir to an exit port. The flexible fluid collector contacts the support surface of the handle and the pump contacting surface of the actuator in a neutral position.

In another embodiment, invention features a method of manufacturing a fluid dispensing personal care product by providing a handle defining a cavity having a support surface. A flexible fluid collector of a pump system is placed on the support surface of the handle. An actuator is mounted on top of the flexible fluid collector. A cover is mounted on the actuator and the handle. The cover is secured to the handle. The flexible fluid collector directly contacts the support surface of the handle and a pump contacting surface of the actuator in a neutral position.

In another embodiment, invention features a fluid dispensing personal care product having a handle defining a cavity with a support surface. A fluid reservoir having a volume of a fluid is configured to mount to the handle. An actuator having a pump contacting surface is mounted to the handle. A pump system including a flexible fluid collector configured to dispense fluid from the fluid reservoir to an exit port is positioned within the handle. The flexible fluid collector has a length extending between a first connector and a second connector and the pump contacting surface of the actuator has a contact length that is about 50% to about 80% of the length of the flexible fluid collector.

Other features and advantages of the invention will be apparent from the description and drawings, and from the claims.

DETAILED DESCRIPTION OF THE INVENTION

Figure 1:
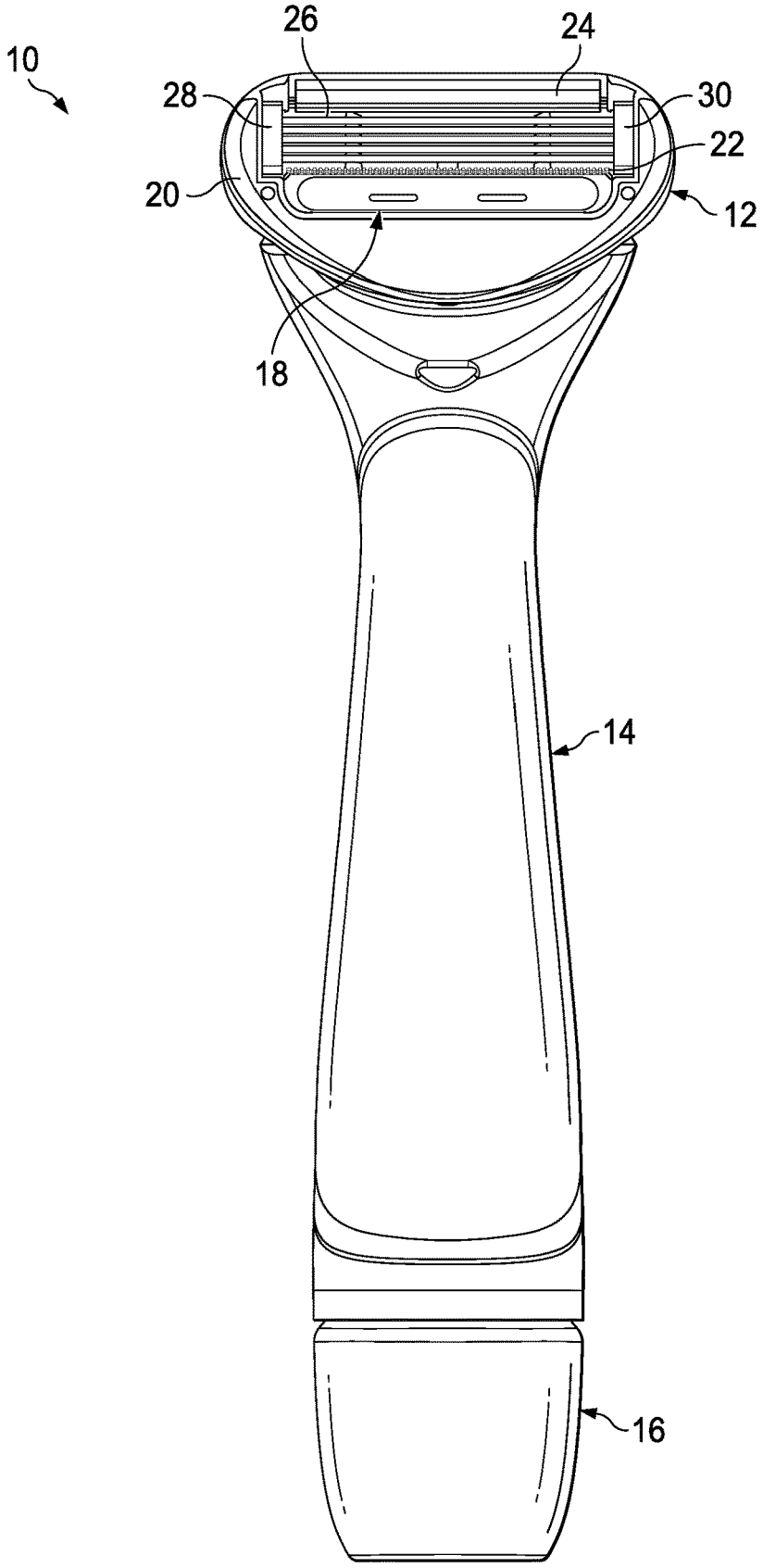
FIG. 1 is a front view of a fluid dispensing personal care product of the present invention.
Figure 2:
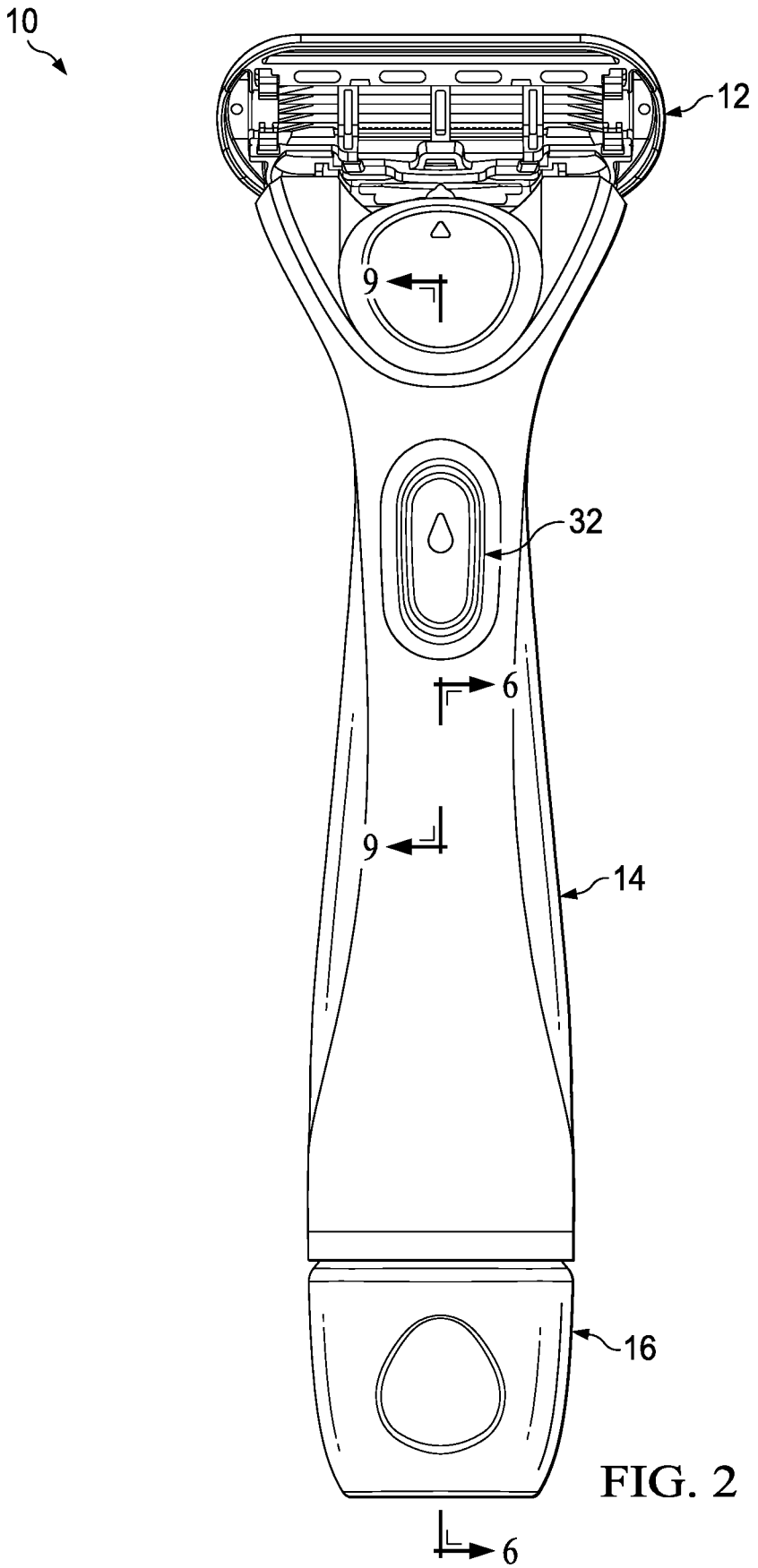
FIG. 2 is a rear view of the fluid dispensing personal care product of FIG. 1

Referring to FIGS. 1 and 2, a front view and a rear view (respectively) of a fluid dispensing personal care product 10 is illustrated. The fluid dispensing personal care product 10 may include a shaving cartridge 12 mounted to a first end of a handle 14. It is understood the shaving razor cartridge 12 may include wet shaving razor cartridges and dry shaving cartridges, such as motorized trimmers. It is also understood the fluid dispensing personal care product 10 may include personal care products other than razors, such as tooth brushes and other dental hygiene products. A fluid reservoir 16 may be mounted to the handle 14. The fluid reservoir 16 may contain a shaving aid, a moisturizer, a cleanser, or other fluid personal care compositions. The fluid reservoir 16 may be removably mounted to the handle 14 so the consumer can replace the fluid reservoir 16 when it is emptied. The fluid dispensing personal care product 10 may be configured to deliver fluid from the fluid reservoir 16 to one or more ports 18. The ports 18 may be positioned within or adjacent to the shaving cartridge 12. In certain embodiments, the ports 18 may be part of the handle 14 which is mounted to the shaving cartridge 12. Alternatively, the ports may be positioned on or within the shaving cartridge 12.

The shaving razor cartridge 12 may include a housing 20. The housing 20 may be injection molded from a polymeric material. The housing 20 may be molded from polymers such as high impact polystyrene (HIPS), but other semi-rigid polymers such as polypropylene (PP), nylon, acrylonitrile butadiene styrene (ABS), polyphenylene ether, polystyrene, and combinations thereof may also be used. A guard 22 may be positioned at a front portion of the housing 20 and a cap 24 may be positioned at a rear portion of the housing 12. The guard 18 may be a unitary elongated member that can be formed of a rigid plastic (e.g., the same material as the housing 16). For example, the guard 22 may be a solid or segmented bar that extends generally parallel to the cap 24 to help support the skin during a shaving stroke. In certain embodiments, the cap 24 may comprise one or more lubricants that are released during shaving. The guard 22 and the cap 24 may define a shaving plane that is tangent to the guard 22 and the cap 24. One or more blade members 26 each having a respective cutting edge may be mounted to the housing 20 between the cap 24 and the guard 22 (i.e., in front of the cap 24 behind the guard 22). Although five blade members 26 are shown, the shaving razor cartridge 12 may have more or fewer blade members 26 depending on the desired performance and cost of the shaving razor cartridge 12. The blade members 26 may be secured to the housing 20 with one or more blade retention members 28 and 30, such as clips.

The shaving razor cartridge 12 may be removable or permanently mounted to the handle 14. For example, the shaving razor cartridge 12 may be detachably mounted to the handle 14 to enable the shaving razor cartridge 12 to be replaced by a fresh shaving razor cartridge 12 when blade sharpness has diminished to an unsatisfactory level. Alternatively, the shaving razor cartridge 12 may be attached permanently to the handle 14 with the intention that the entire fluid dispensing personal care product 10 be discarded when the blade or blades 28 have become dulled.

As shown in FIG. 2, an actuator 32 (e.g., button) may be positioned on the handle 14. As will be described in greater detail below, the actuator 32 may manually activate a pump system (not shown) to prime and dispense fluid from the fluid reservoir 16 to the one or more ports 18 (FIG. 1). For example, a user may press the actuator 32 in a downward direction to cycle the pump system. Alternatively, it is understood that an electronically controlled actuator may be used.

Figure 3:
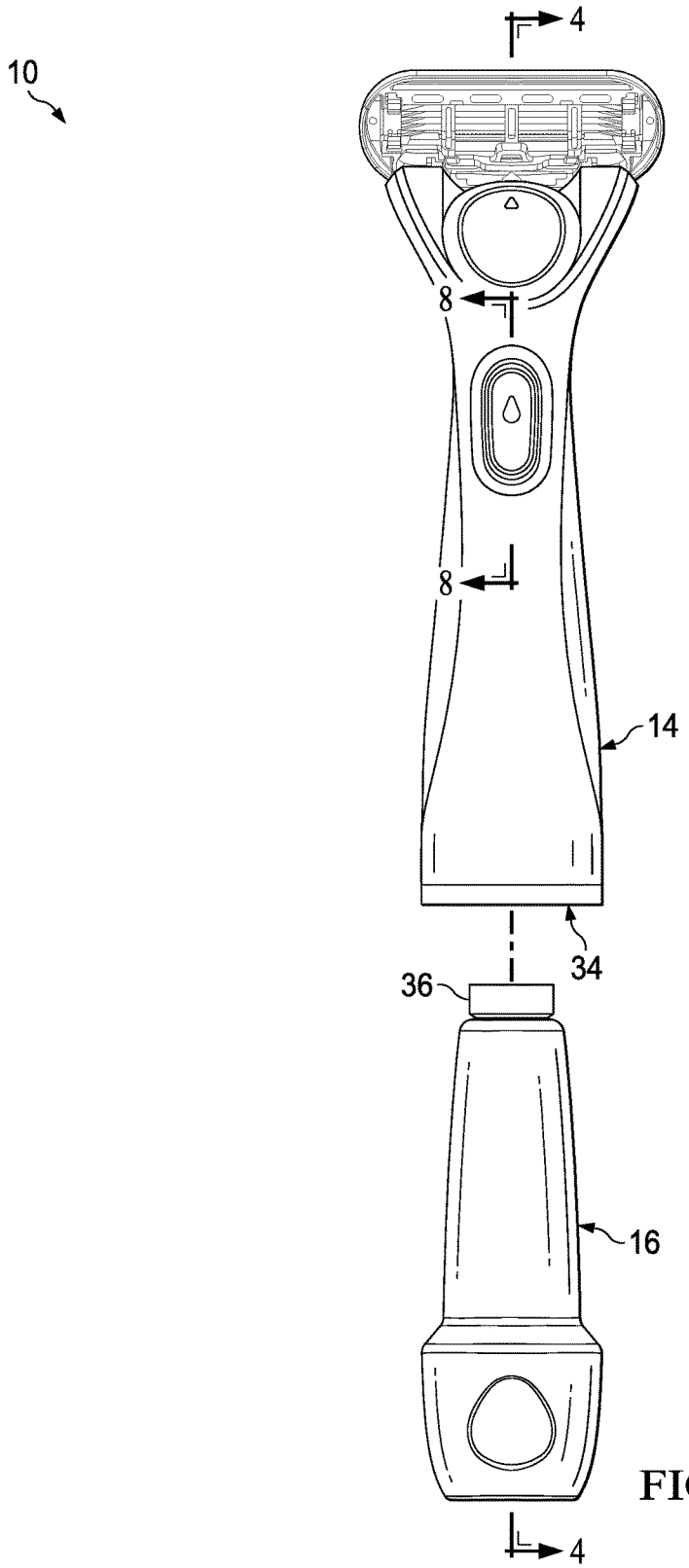
FIG. 3 is a rear assembly view of the fluid dispensing personal care product.

Referring to FIG. 3, an assembly view of the fluid dispensing personal care product 10 is illustrated with the fluid reservoir 16 removed from the handle 14, e.g., in an unloaded position. The fluid reservoir 16 may be provided to a consumer with the fluid reservoir 16 separated from the handle 14, to allow for a more effective seal of the fluid within the fluid reservoir, thus improving the product shelf life. The handle 14 may define a cavity 34 dimensioned to receive at least a portion of the fluid reservoir 16. As will be described in greater detail below, the fluid reservoir 16 may include a top 36 having a seal (not shown) that the consumer may penetrate during the loading of the fluid reservoir 16 to the handle 14.

Figure 4:
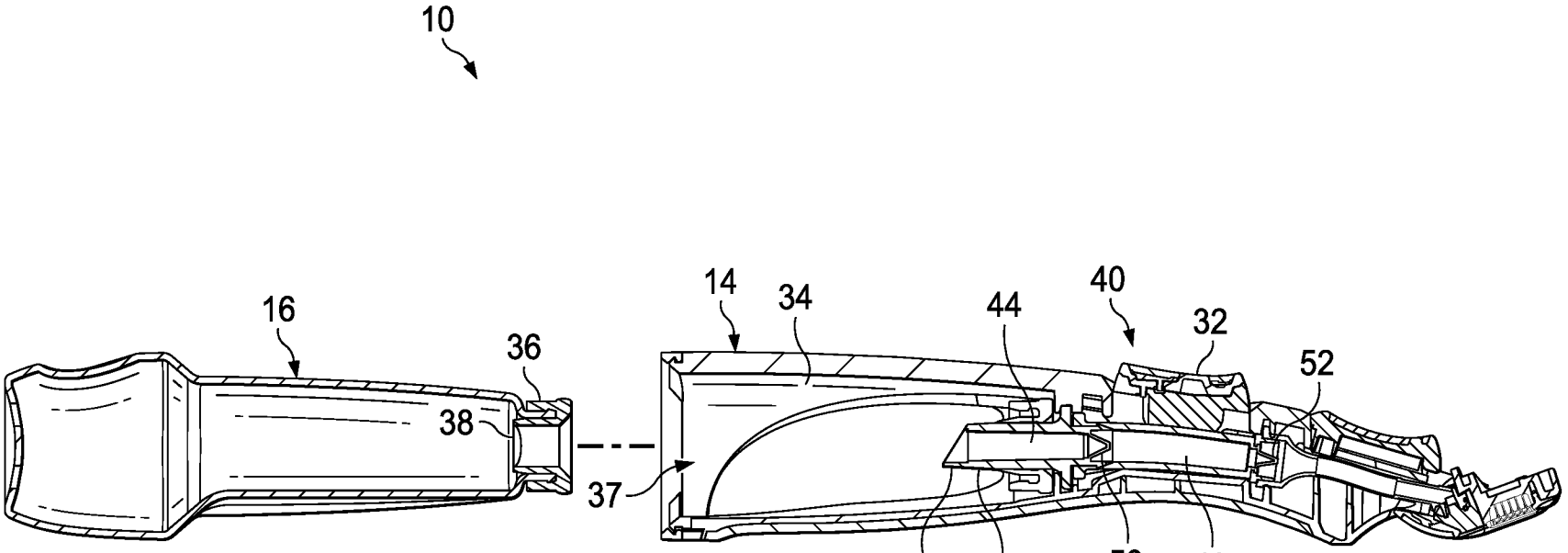
FIG. 4 is a cross section view of the fluid dispensing personal care product, taken generally along the line 4-4 of FIG. 3.

Referring to FIG. 4 a cross section view of the fluid dispensing personal care product 10 is shown, taken generally along the line 4-4 of FIG. 3. The fluid reservoir 16 may be provided in a sealed condition with a seal 38 securely containing a predetermined volume of fluid within the fluid reservoir 16. In certain embodiments, the seal 38 may be part of the top 36. The fluid reservoir 16 may also be provided with a predetermined head space volume (e.g., air) in the sealed condition. The handle 14 may contain a pump system 40 configured to deliver the fluid from the fluid reservoir 16 to the exit port 18 (FIG. 1) when the seal 38 is ruptured. The pump system 40 may include a piercer 42 configured to penetrate the seal 38 of the fluid reservoir 16. For example, the top 36 of the fluid reservoir 16 may define an opening 37 dimensioned to receive and seal against the piercer 42 to prevent fluid from leaking into the cavity 34. Accordingly, fluid is forced out of the fluid reservoir 16 and into the pump system 40, e.g., into the piercer 42.

The piercer 42 may have a displacement volume that is greater than 20% of the head space volume of the fluid reservoir 16. For example, the piercer 42 may have a displacement volume of about 20% to about 125% and more preferably about 25% to about 90% of the head space volume. The displacement volume of the piercer 42 may be calculate by either by the volume of fluid displaced from the fluid reservoir 16 into the pump system 40 (e.g., into the piercer 42) or the volume of the piercer 42 measured from the position on the piercer sealed against the opening 37 to an end 45 of the piercer 42. The piercer 42 may displace a volume of fluid from the fluid reservoir 16 to facilitate priming of the pump system 40. Accordingly, fewer cycles (e.g., presses of the actuator 32) are required for fluid to travel from the fluid reservoir 16 to the ports 18. For example, the piercer 42 may define an opening 44 through which fluid from the fluid reservoir 16 is forced to flow because of the limited head space volume. In certain embodiments, the head space volume relative to the displacement volume of the piercer 42 may facilitate the opening 44 of the piercer to be filled with fluid.

The pump system 40 may include a flexible fluid collector 48 (e.g., a silicone tube) having one or more valves (e.g. an entry valve 50 and an exit valve 52). The opening 44 of the piercer 42 may extend from the tip 45 of the piercer to the entry valve 50 in the flexible fluid collector 48. In certain embodiments, fluid from the fluid reservoir 16 may fill the piercer opening 44 and at least a portion of the flexible fluid connector 48. However, if the displacement volume is too great, excess fluid may spill over and leak between the fluid reservoir 16 and the handle 14 during loading of the fluid reservoir 16. Accordingly, the displacement volume of the piercer 42 may be less than 125% of the head space volume. In certain embodiments, the displacement volume of the piercer 42 may be greater than of the head space volume. The displacement volume of the piercer 42 may be adjusted depending on the volume of the pump system 40. For example, when the piercer 42 is fully inserted into the fluid reservoir 16, fluid may pre-fill the pump system 40. Thus, the pump system 40 may need minimal cycles transfer fluid to the exit port 18. In certain embodiments, the pump system 40 may dispense fluid from the exit port in less than 10 cycles of the pump system, preferably less than 7 cycles of the and more preferably less than 5 cycles.

During operation, a consumer may put a downward force on the actuator 32 to compress the flexible fluid collector 48, which opens one or more of the valves 50 and 52 to force air and fluid out of the flexible fluid collector 48 to the one or more exit ports 18 (FIG. 1). When the force on the actuator 32 is released, the flexible fluid collector 48 may return to its neutral position and receive more fluid from the fluid reservoir 16, thus filling the flexible fluid collector 48.

Figure 5:
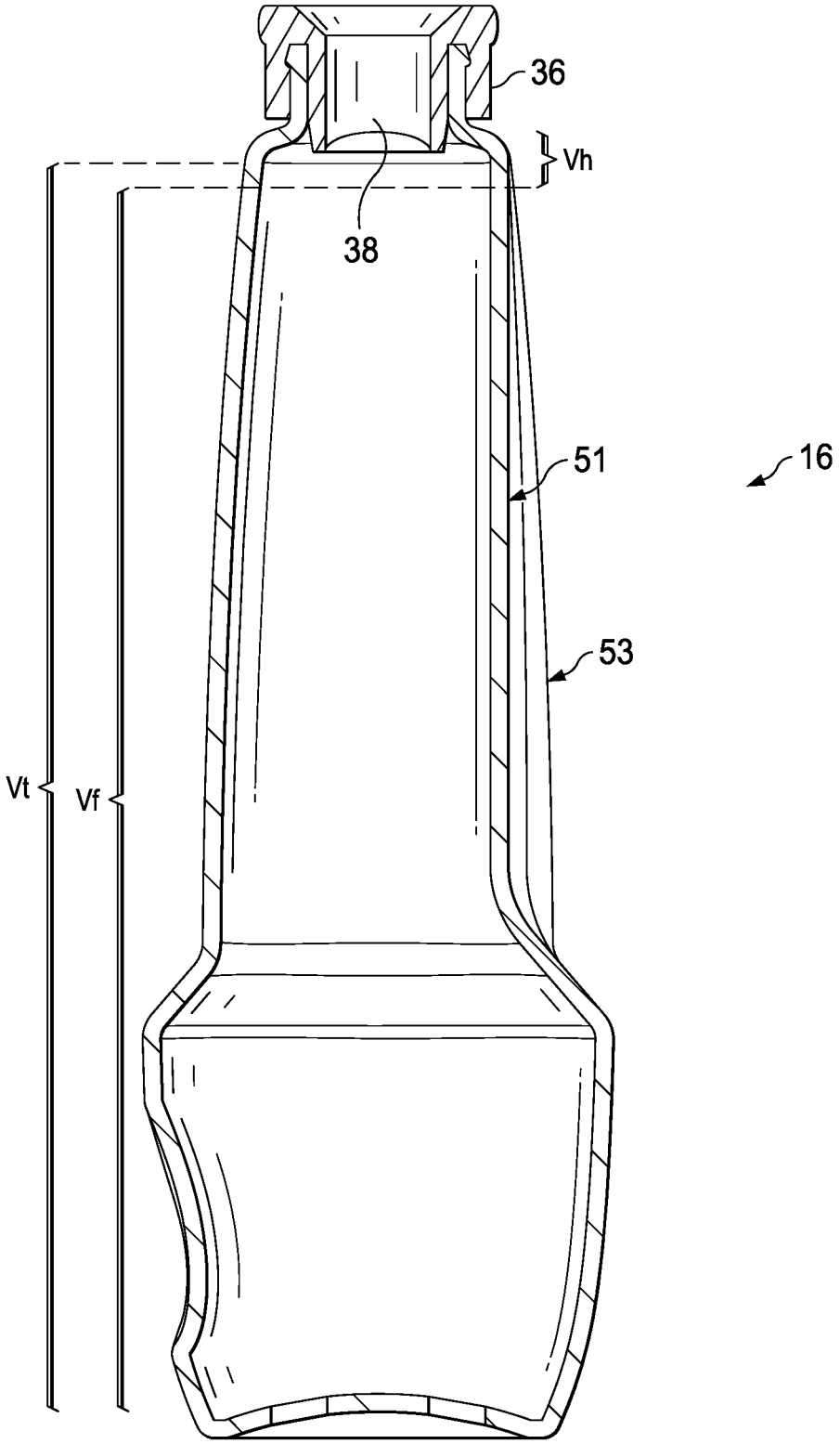
FIG. 5 is a cross section view of a fluid reservoir shown in FIGS. 3 and 4.

Referring to FIG. 5, a cross section view of the fluid reservoir 16 of FIG. 4 is illustrated. The fluid reservoir 16 may include a delaminating bag (e.g., collapsible) 51 positioned within a bottle 53. The fluid reservoir 16 (e.g., the delaminating bag 51) may have a fillable volume (i.e., total potential volume sealed within the fluid reservoir 16) "Vt" that is equal to a fluid volume "Vf" (i.e., volume of fluid sealed within the fluid reservoir 16) plus a head space volume "Vh" (non fluid volume) sealed within the fluid reservoir 16. In certain embodiments, the fillable volume "Vt" may be about 8 mL to about 30 mL. Typical fluid filling processes must allow for head space volume within the fluid reservoir 16 to allow the top 36 to be mounted and the fluid reservoir 16 to be sealed without excessive spilling over of the fluid (which creates unnecessary waste of fluid). However, the extra head space adds more air, which must be displaced by the pump system 40 (FIG. 4). Accordingly, more cycles of the pump system 40 (e.g., presses of the actuator 32) are required, which can be an annoyance to a user. The proper balance between the fluid volume and the head space volume minimizes the number of cycles to prime the pump system 40 (FIG. 4) while also minimizing excess waste of fluid during sealing of the fluid reservoir 16. In certain embodiments, the head space volume "Vh" may be greater than zero, for example, about 0.5 mL to about 2 mL. The head space volume "Vh" may be about 2% to about 10% of the fillable volume "Vt".

Figure 6:
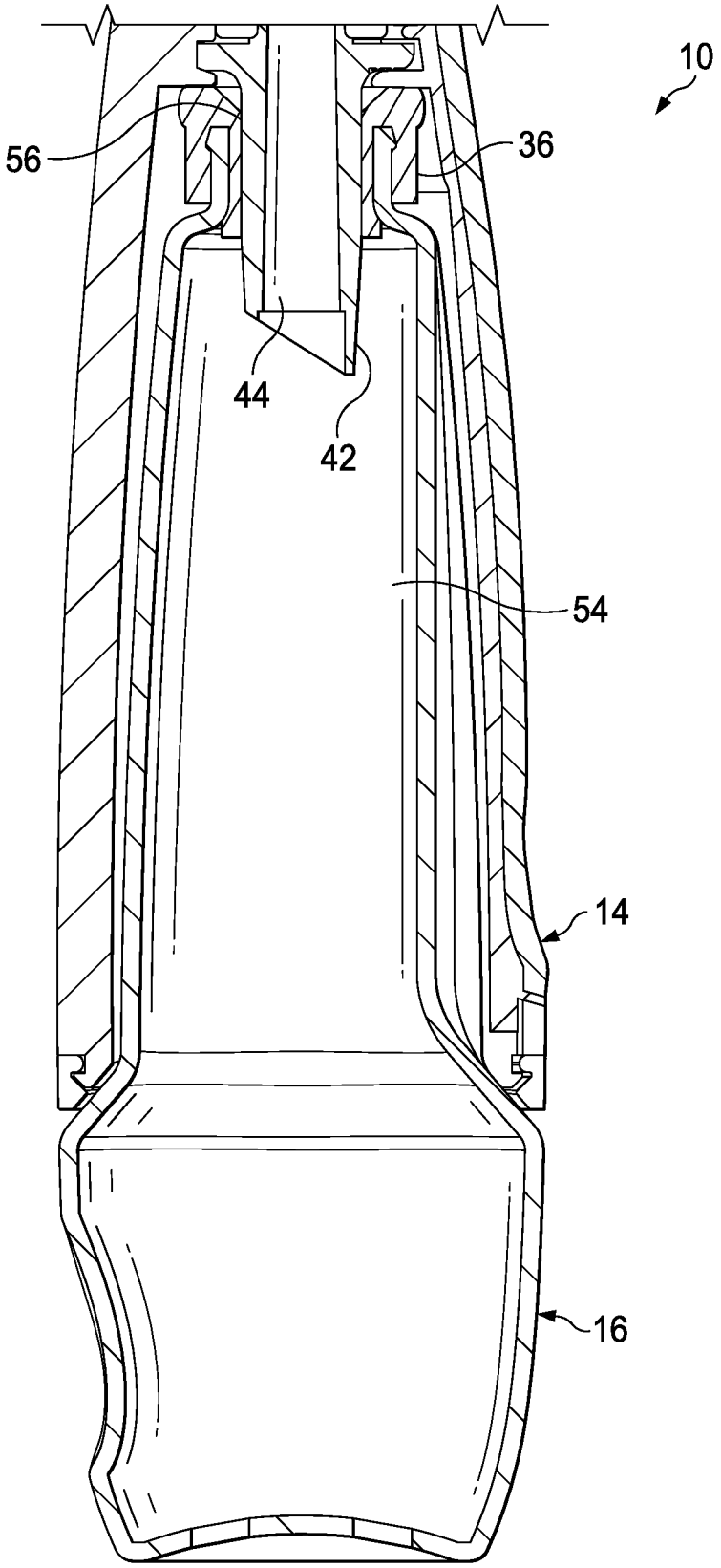
FIG. 6 is a cross section view of a portion of the fluid dispensing personal care product, taken generally along the line 6-6 of FIG. 2.

Referring to FIG. 6, is a cross section view of a portion of the fluid dispensing personal care product 10, taken generally along the line 6-6 of FIG. 2. The piercer 42 may extend into fluid 54 contained within the fluid reservoir 16, displacing the head space volume (FIG. 5) and forcing the fluid 54 into the opening 44 of the piercer 42. The piercer 42 may be sealed against an inner surface 56 of the top 36 to prevent the fluid 54 from leaking during use and as the fluid reservoir is mounted to the handle 14. Accordingly, there may be minimal head space volume when the fluid reservoir 16 is fully mounted to the handle 14 (e.g., the piercer 42 sealed against the inner surface 56 of the top 36), thus minimizing or eliminating any air in the fluid reservoir 16.

Figure 7:
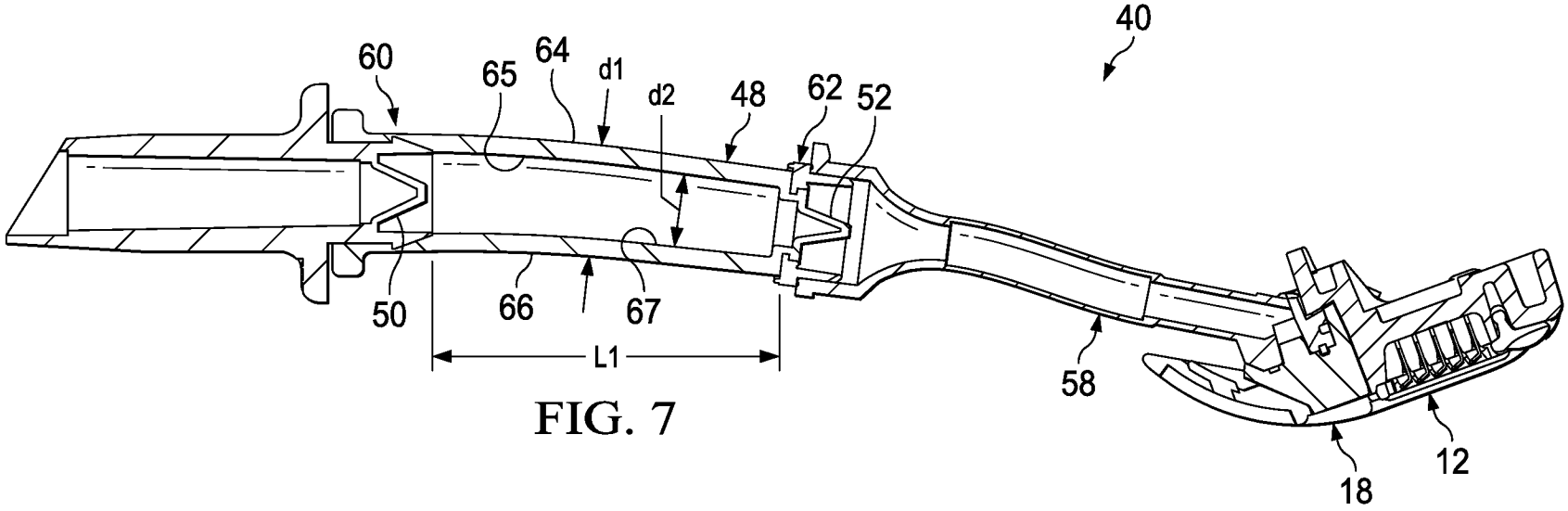
FIG. 7 is a cross section view of a pump system of FIG. 4.

Referring to FIG. 7, a cross section view of the pump system 40 is illustrated. The flexible fluid collector 48 may be configured to dispense fluid through a conduit 58 to the exit port 18 on the shaving cartridge 12. The flexible fluid collector 48 may have a length "L1" extending between a first connector 60 and a second connector 62 of about 10 mm to about 30 mm. In certain embodiments, the first and second connectors 60 and 62 may support the flexible fluid connector 48. The entry valve 50 may be positioned at least partially within the first connector 60 and the exit valve 52 may be positioned within second connectors 62. The flexible fluid collector 48 may have a distance "d1" (e.g., an outside diameter for a tube shape) of about 4 mm to about 8 mm. The distance "d1" may be measured as a vertical distance between a pair of opposing external walls 64 and 66 of the flexible fluid collector 48. An upper internal wall 65 of the flexible fluid collector 48 may contact an opposing lower internal wall 67 of the flexible fluid collector 48 in a fully compressed position to force liquid out of the fluid collector 48 and toward the exit port 18. In certain embodiments, a fully compressed position of the flexible fluid collector 48 may be less than 40% of a distance "d2" between the upper internal wall 65 of the flexible fluid collector 48 and the opposing lower internal wall 67 of the flexible fluid collector 48 in a neutral position (e.g., resting position).

Figure 8:
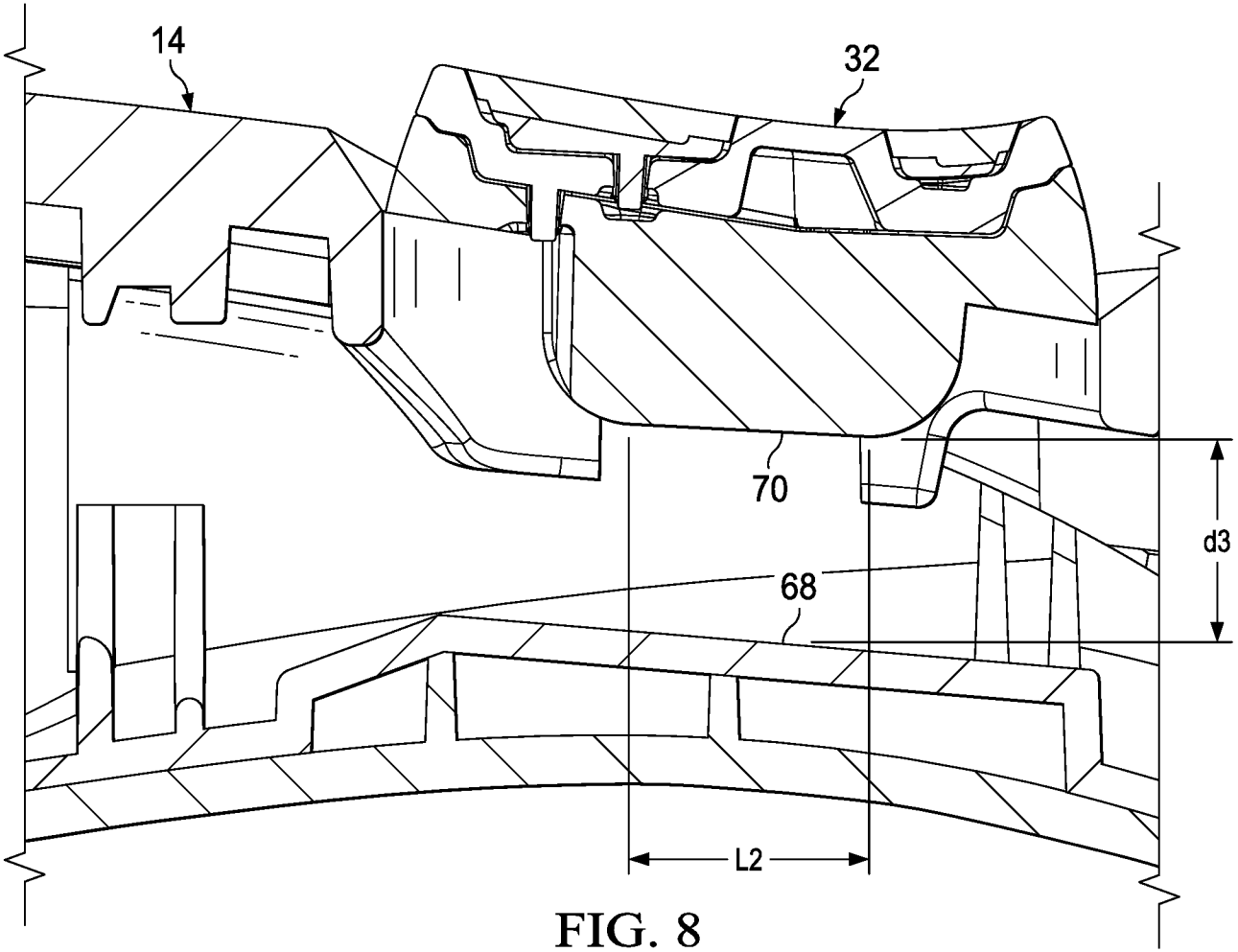
FIG. 8 is an enlarged cross section view of a handle, taken generally along the line 8-8 of FIG. 3.

Referring to FIG. 8, an enlarged cross section view of the handle 14 is illustrated, taken generally along the line 8-8 of FIG. 3. The handle 14 may define the cavity 34 having a support surface 68. As will be described in greater detail below, the support surface 68 may support the fluid collector 48. The actuator 32 may have a pump contacting surface 70 having a contact length "L2" of about 8 mm to about 18 mm. A forward and/or a rearward surface of the pump contacting surface 70 may have a radius of about 1 mm to about 4 mm. The radii may help prevent the actuator 32 from tearing or damaging the fluid collector 48 (not shown), especially after extended use. A vertical distance "d3" between the support surface 68 of the handle 14 and the pump contacting surface 70 of the actuator may be about 4 mm to about 8 mm. The distance "d3" may be less than the distance "d1" (FIG. 7) in the neutral position (e.g., prior to actuation by a user), thus slightly compressing fluid collector 48 (FIG. 7). The slight compression may act as a spring mechanism to bias the actuator 32, as well as, decrease the necessary travel distance of the actuator to fully compress the fluid collector 48 (FIG. 7), thus improving efficiency of each pump cycle. In certain embodiments, the distance "d1" (FIG. 7) between the external walls 64 and 66 may be greater than 100% to about 110% of the distance "d3" between the pump contacting surface 70 of the actuator 32 and the support surface 68.

In certain embodiments, the contact length "L2" of the pump contacting surface 70 of the actuator 32 may be about 40% to about 90% and more preferably about 50% to about 80% of the length "L1" of the flexible fluid collector 48 (FIG. 7) to allow for maximum efficiency. It is believed, without being held to theory that, if the pump contacting surface 70 of the actuator 32 was less than 50% of the length "L1" of the flexible fluid collector 48 (FIG. 7), the pump system would not be efficient because less fluid would be dispensed per full compression of the fluid collector 48. If the pump contacting surface 70 of the actuator 32 was greater than 80% of the length "L1" of the flexible fluid collector 48 (FIG. 7), the force required to fully compress the fluid collector may be too high. Furthermore, the higher force may cause the actuator 32 to damage the fluid collector 48.

Figure 9:
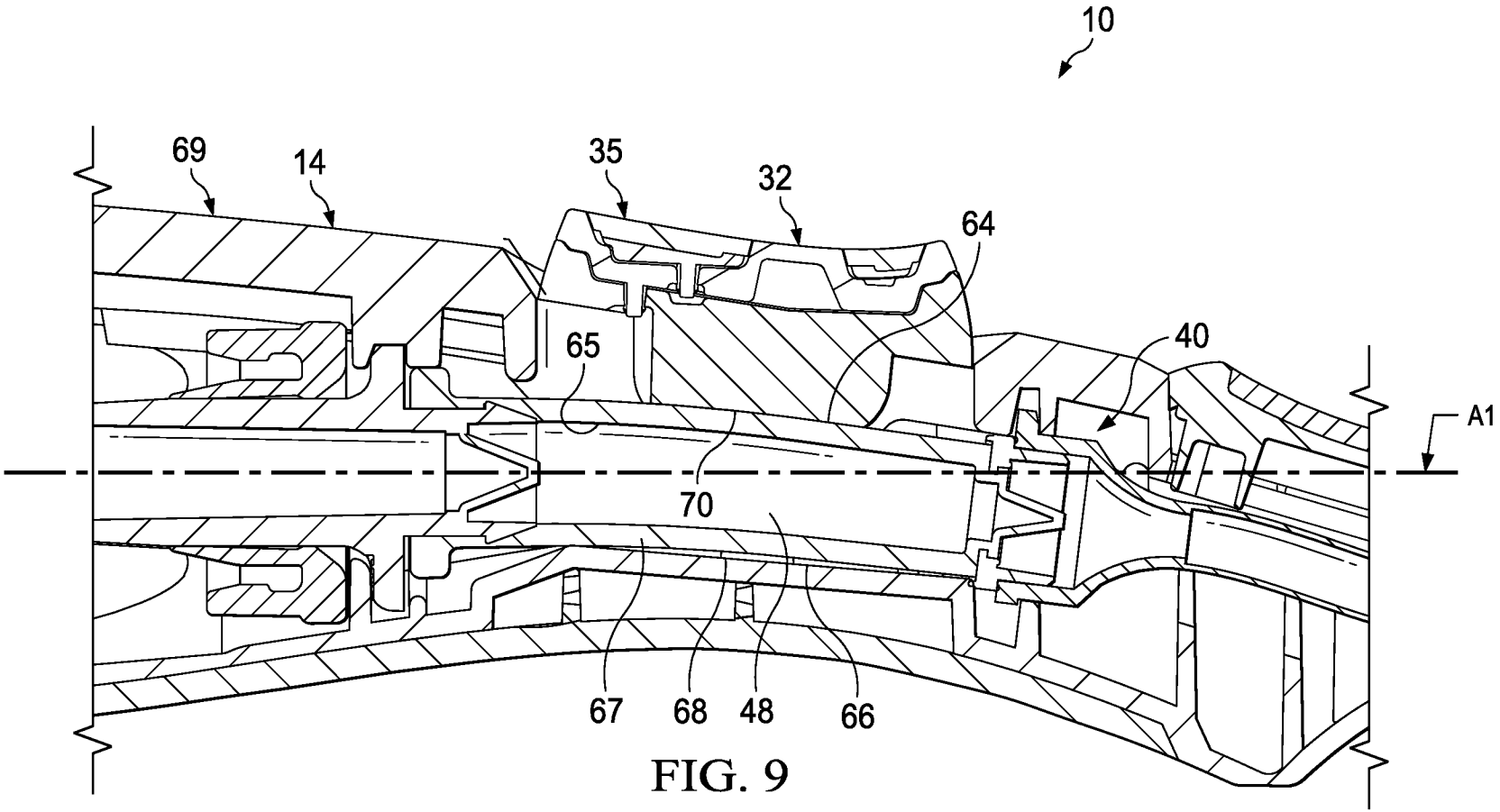
FIG. 9 is a cross section view of the fluid dispensing personal care product, taken generally along the line 9-9 of FIG. 2.

Referring to FIG. 9, an enlarged cross section view of the fluid dispensing personal care product 10 is shown, taken generally along the line 9-9 of FIG. 2. The fluid dispensing personal care product 10 may be assembled by placing the pump system 40 within the cavity 34 defined by the handle 14. The flexible fluid collector 48 of a pump system 40 may be placed on the support surface 68 of the handle 14. The actuator 32 may then be placed on top of the flexible fluid collector 48. In certain embodiments, the actuator 32 may be mounted to a cover 69 to form a cover sub-assembly, which is then mounted to the handle 14. The cover 69 may then be secured to the handle 14 (e.g., via ultrasonic welding or snap fitting). In other embodiments, the actuator 32 may be placed on top of the flexible fluid collector 48 and the cover 69 may then be mounted over a portion of the actuator 32 as the cover 69 is secured to the handle 14. The assembly of the fluid dispensing personal care product 10 may cause the flexible fluid collector 48 to contact the support surface 68 of the handle 14 and the pump contacting surface 70 of the actuator in a neutral position (e.g., no external force applied to a top surface 35 the actuator 32).

In a neutral position, the flexible fluid collector 48 may be filled or partially filled with air. Accordingly, the flexible fluid collector 48 may need to be primed to be able to pump fluid. The external wall 64 of the flexible fluid collector 48 may face and contact the pump contacting surface 70. The external wall 66 of the flexible fluid collector 48 may face and contact the support surface 68 of the handle 14. Accordingly, the flexible fluid collector 48 may be compressed in the neutral position (i.e., pre-compressed). In certain embodiments, the flexible fluid collector 48 may be compressed about 5% to about 10% in the neutral position, which may allow for improved user feedback, improved biasing of the actuator, and decreased travel of the actuator 32 to fully compress the flexible fluid collector 48.

In certain embodiments, the actuator 32 may be a manual button that travels in a direction transverse to a longitudinal axis A1 of the flexible fluid collector 48. A user may press in a downward direction the top surface 35 of the actuator 32 to cycle the pump system 40. The pump contacting surface 70 of the actuator 32 may directly contact the flexible fluid collector 48 (i.e., the external wall 64), to force the upper internal wall 65 to contact the opposing lower internal wall 67 of the flexible fluid collector 48 in a fully compressed position to cycle the pump system 40 and dispense fluid. The support surface 68 of the handle 14 may directly contact the external wall 66.

Figure 10:
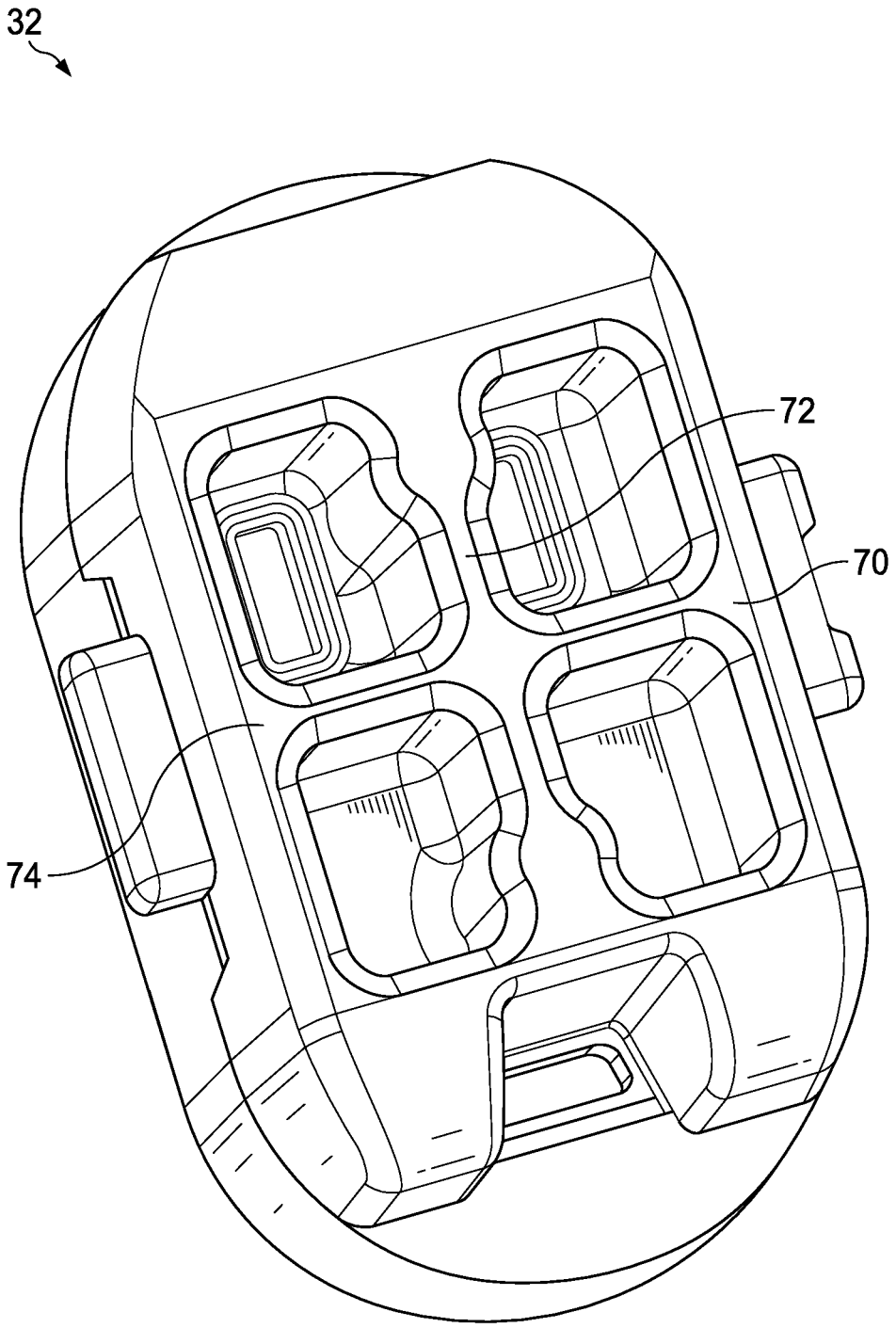
FIG. 10 is a bottom perspective of an actuator.

Referring to FIG. 10, a bottom perspective view of the actuator 32 is illustrated. The pump contacting surface 70 of the actuator 32 may include a pair of cross ribs 72 and 74 that may provide for additional contact area toward a center of the pump contacting surface 70 for improved compression of the flexible fluid collector 48. One of the cross ribs 72 may be a longitudinal rib 72 that contacts the flexible fluid collector 48. The longitudinal rib 72 may have a width of about 0.5 mm to 10 mm and more preferably about 0.5 mm to about 2 mm. In certain embodiments, the longitudinal rib 72 may be wider at the center and at either end. The other rib 74 may be transverse to the longitudinal rib 72 and the flexible fluid collector 48. In certain embodiments, the longitudinal rib 72 may be positioned directly on top of the flexible fluid collector 48. The rib 74 transverse to the longitudinal rib 72 may provide addition contact area as the flexible fluid collector 48 is compressed and flattens out (e.g., becomes wider). The rib 74 may have a width of about 0.5 mm to about 10 mm and more preferably about 0.5 mm to about 2 mm.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluid dispensing personal care product comprising:
- a handle defining a cavity having a support surface;
- a fluid reservoir containing a volume of a fluid, the fluid reservoir configured to attach to the handle;
- an actuator on the handle having a pump contacting surface;
- a pump system positioned within the handle includes a flexible fluid collector configured to dispense fluid from the fluid reservoir to an exit port, wherein the flexible fluid collector contacts the support surface of the handle in a neutral position and the pump contacting surface of the actuator in the neutral position.

2. The fluid dispensing personal care product of claim 1, wherein flexible fluid collector directly contacts the support surface of the handle and the pump contacting surface of the actuator in the neutral position.

3. The fluid dispensing personal care product of claim 1, wherein the pump system is compressed 5% to 10% in the neutral position.

4. The fluid dispensing personal care product of claim 1, wherein an upper internal wall of the flexible fluid collector contacts an opposing lower internal wall of the flexible fluid collector in a fully compressed position.

5. The fluid dispensing personal care product of claim 1, wherein a distance between an upper internal wall of the flexible fluid collector and an opposing lower internal wall of the flexible fluid collector in a fully compressed position is less than 40% of a distance between said upper internal wall of the flexible fluid collector and said opposing lower internal wall of the flexible fluid collector in said neutral position.

6. The fluid dispensing personal care product of claim 5 wherein the pump contacting surface of the actuator has a contact length that is 40% to 90% of the length of the flexible fluid collector.

7. The fluid dispensing personal care product of claim 1, wherein the flexible fluid collector has a length from 10 mm to 30 mm extending between a first connector and a second connector.

8. The fluid dispensing personal care product of claim 7 wherein the pump contacting surface of the actuator has a contact length that is 50% to 80% of the length of the flexible fluid collector.

9. The fluid dispensing personal care product of claim 1, wherein the flexible fluid collector has a vertical distance from an external wall facing the support surface to an external wall facing the pump contacting surface of the actuator that is 90% to 110% of a vertical distance between the pump contacting surface of the actuator to the support surface.

10. The fluid dispensing personal care product of claim 1 wherein the pump contacting surface of the actuator comprises a longitudinal rib contacting the flexible fluid collector.

11. The fluid dispensing personal care product of claim 10 wherein the longitudinal rib has a width of 0.5 mm to 10 mm.

12. The dispensing personal care product of claim 1 wherein the pump contacting surface of the actuator comprises a rib transverse to and contacting the flexible fluid collector.

13. The dispensing personal care product of claim 12 wherein the rib has a width of 0.5 mm to 10 mm.

14. The dispensing personal care product of claim 1 wherein the pump contacting surface of the actuator comprises a pair of cross ribs contacting the flexible fluid collector.

15. The dispensing personal care product of claim 1 wherein the flexible fluid collector comprises a pair of valves.

16. A fluid dispensing personal care product comprising:

a handle defining a cavity having a support surface;

a fluid reservoir having a volume of a fluid and is configured to mount to the handle;

an actuator having a pump contacting surface and is mounted to the handle; and a pump system including a flexible fluid collector configured to dispense fluid from the fluid reservoir to an exit port is positioned within the handle, wherein the flexible fluid collector has a length extending between a first connector and a second connector and the pump contacting surface of the actuator has a contact length that is 50% to 80% of the length of the flexible fluid collector and the pump contacting surface comprises a pair of cross ribs that includes a longitudinal rib positioned directly on top of the flexible fluid collector.

17. The fluid dispensing personal care product of claim 16 wherein the flexible fluid collector has a vertical distance from an external wall facing the support surface to an external wall facing the pump contacting surface of the actuator that is greater than 100% to 110% of a vertical distance between the pump contacting surface of the actuator to the support surface.

18. The fluid dispensing personal care product of claim 16 wherein the actuator is a manual button that travels in a direction transverse to a longitudinal axis of the flexible fluid collector and the pump contacting surface directly contacts the flexible fluid collector in a neutral position.

19. A method of manufacturing a fluid dispensing personal care product comprising the steps of:

providing a handle defining a cavity having a support surface;

placing a flexible fluid collector of a pump system on the support surface of the handle;

mounting an actuator on top of the flexible fluid collector;

mounting a cover on the actuator and the handle; and securing the cover to the handle;

directly contacting the flexible fluid collector with the support surface of the handle in a neutral position; and directly contacting the flexible fluid collector with a pump contacting surface of the actuator in the neutral position.

20. The method of claim 19 wherein said mounting the actuator and said mounting the cover comprises mounting a cover sub-assembly comprising the actuator and the cover to the handle.

* * * * *